US005327691A

United States Patent [19]

Eryou

[11] Patent Number: 5,327,691

[45] Date of Patent: * Jul. 12, 1994

[54] TRANSFER PAD COVER

[76] Inventor: Dennis N. Eryou, 8 Ivy Pl., Huntington, N.Y. 11743

[ * ] Notice: The portion of the term of this patent subsequent to Mar. 30, 2010 has been disclaimed.

[21] Appl. No.: 945,661

[22] Filed: Sep. 21, 1992

Related U.S. Application Data

[63] Continuation-in-part of Ser. No. 764,446, Sep. 24, 1991, Pat. No. 5,197,240.

[51] Int. Cl.[5] ..... E04B 7/16

[52] U.S. Cl. ..... 52/66; 52/64

[58] Field of Search ..... 52/63, 64, 66, 69; 135/87, 96, 103, 109; 49/33

[56] References Cited

U.S. PATENT DOCUMENTS

| | | | |
|---|---|---|---|
| 2,838,767 | 6/1958 | Matlock | 49/33 |
| 3,009,211 | 11/1961 | Hansen et al. | 52/66 |
| 3,938,621 | 2/1976 | Bobbit, Jr. | 184/1.5 |
| 5,197,240 | 3/1993 | Eryou | 52/66 |

*Primary Examiner*—Carl D. Friedman
*Assistant Examiner*—Creighton Smith
*Attorney, Agent, or Firm*—Darby & Darby

[57] ABSTRACT

A transfer pad cover includes a frame structure covered by a water-proof sheet material. The frame structure is supported by bar joists that are mounted for movement along tracks. The entire structure is moved by hand or motor or by a truck from which a liquid transfer will be made to a position adjacent the transfer pad during the transfer operation. When the material and frame structure are sufficiently weighted down so that it is unsafe to move the cover, the joists will rest on a ground surface, preventing movement of the cover. In an alternate embodiment, the rails are sloped and the truck pushes the cover off of the pad. When the truck leaves the pad, the slope of the rails causes the cover to automatically return to protect the pad under the influence of gravity. Other embodiments of the transfer pad cover include covers that fold or pivot vertically to expose the pad. These other embodiments have several additional advantages such as decreased space requirements for the operation of the cover.

9 Claims, 8 Drawing Sheets

TRANSFER PAD COVER

This application is a continuation-in-part of Ser. No. 07/764,446, filed Sep. 24, 1991 now U.S. Pat. No. 5,197,240.

FIELD OF THE INVENTION

This invention relates to ground covering structures. More specifically, this invention relates to a structure that covers a truck transfer pad and protects the pad from precipitation when the pad is not in use.

BACKGROUND OF THE INVENTION

As environmental concerns become increasingly prevalent in all aspects of industrial and consumer life, the practical and financial demands placed on businesses by strict regulatory standards have skyrocketed. In perhaps no other industry has this been more apparent than in the handling and disposal of regulated materials, such as hazardous wastes and petroleum products. The procedures for containing, transporting, and disposing these materials have become a conglomerate of regulations and standards. Conforming to these standards, while maintaining cost-efficiency and productivity can mean the difference between profitability and failure.

One segment of the industry with a particular set of environmental concerns is the transportation of liquid products. These products may include liquids with high heavy metal concentrations, petroleum products, or other liquids deemed to be dangerous should they be released into the environment or water supply. Tank trucks have proved effective for safely transporting many of these liquids, but problems can arise in transferring the liquids to and from the trucks, such as spills or leaks. Some dry chemicals, such as powdered agricultural chemicals are often transported similarly.

A known solution to this problem is to construct a transfer pad on which the trucks can safely transfer the materials. The transfer pad generally has a slight bowl-like shape, with a gently sloping basin floor leading toward a central sump area. Should any material be spilled during the transfer process, it will be retained in the sump until it can be disposed of properly, such as by being vacuumed out and further transported by truck to a disposal site. Obviously, the pad is formed from a material that is impervious to the liquid being transferred, such as asphalt, concrete or coated concrete.

However, in solving the transfer spill problem, another has arisen with respect to these transfer pads, namely, the accumulation of precipitation. Since a small amount of waste material is retained on the pad or held in the sump, any rainfall or melted snow accumulating on the pad or sump becomes immediately contaminated, and must be disposed of as contaminated waste. At current liquid disposal costs of approximately one dollar per gallon, transporting accumulated rainwater can add up to thousands of dollars per year for a single pad. Worse yet, unexpectedly heavy rainfall might cause the sump to overflow, carrying the regulated products into the neighboring ground areas.

This concern can be met by covering the pad with a roofed building or a canopy. Unfortunately, such buildings can be quite expensive and would require major ventilation systems to expel truck exhaust gases and waste product vapor. Taxes, permits, inspections and fees for such a permanent dwelling also make buildings an unworkable solution. A fixed canopy reduces the cost and vapor handling requirements, but is ineffective in keeping even slightly wind-blown rain off of the transfer pad.

A less expensive known solution is to cover the pad with a standard tarpaulin fastened around the edges of the pad. The tarpaulin must be securely fastened to the ground to prevent it from blowing away in any strong wind, which makes it difficult for a truck operator to make use of the pad. He must first get out of the truck, remove the tarpaulin, usually by untying and then rolling it, and then get back in the truck to drive it onto the pad to begin the fluid transfer. When the transfer is complete, he must drive off the pad, get out of the truck, and cover the pad with the tarpaulin, which usually includes unrolling or unfolding it and tying it down in several places. Tarpaulins also tend to collect water and snow on their top surface, making them difficult to move.

OBJECTS OF THE INVENTION

It is thus an object of the invention to provide a transfer pad cover that is easily and quickly moved on and off the pad.

It is another object to provide a cover that can be moved laterally across an uneven transfer pad.

It is another object to provide a transfer pad cover that includes the benefits of a permanent building structure, without the financial and legal disadvantages of such a dwelling.

It is a further object to provide a cover that can withstand a full snow load and automatically indicates when the snow load has made it unsafe to move the cover. The cover is also designed to allow easy removal of the snow from the cover and to allow rain to run-off the cover by gravity.

It is a further object to provide a cover that is moved longitudinally, i.e., along the length of the pad, by a truck entering the pad, and returns to the pad automatically upon the truck's departure.

It is another object that the cover be able to withstand considerable wind gusts without blowing off of the pad.

It is yet another object to provide a cover that is lightweight, easy to manufacture and assemble, and relatively inexpensive.

SUMMARY OF THE INVENTION

In accordance with the objects of the invention, a transfer pad cover comprises a frame structure covered by a water-proof material. The frame structure is supported by bar joists that are mounted for movement along tracks. The entire structure is moved by hand or motor to a position adjacent the transfer pad during transfer. When the material and frame structure are weighted down, making it unsafe to move the cover, the joists will rest on a ground surface, preventing movement of the cover. In an alternate embodiment, the rails are sloped and the truck pushes the cover off of the pad. When the truck leaves the pad, the slope of the rails causes the cover to automatically return to its original covering position.

The foregoing and other objects, advantages, and embodiments of this invention will become apparent to those skilled in the art upon reading the detailed description of the preferred embodiments in conjunction with a review of the appended drawings.

DETAILED DESCRIPTION OF THE PREFERRED EMBODIMENTS

Figure 1:
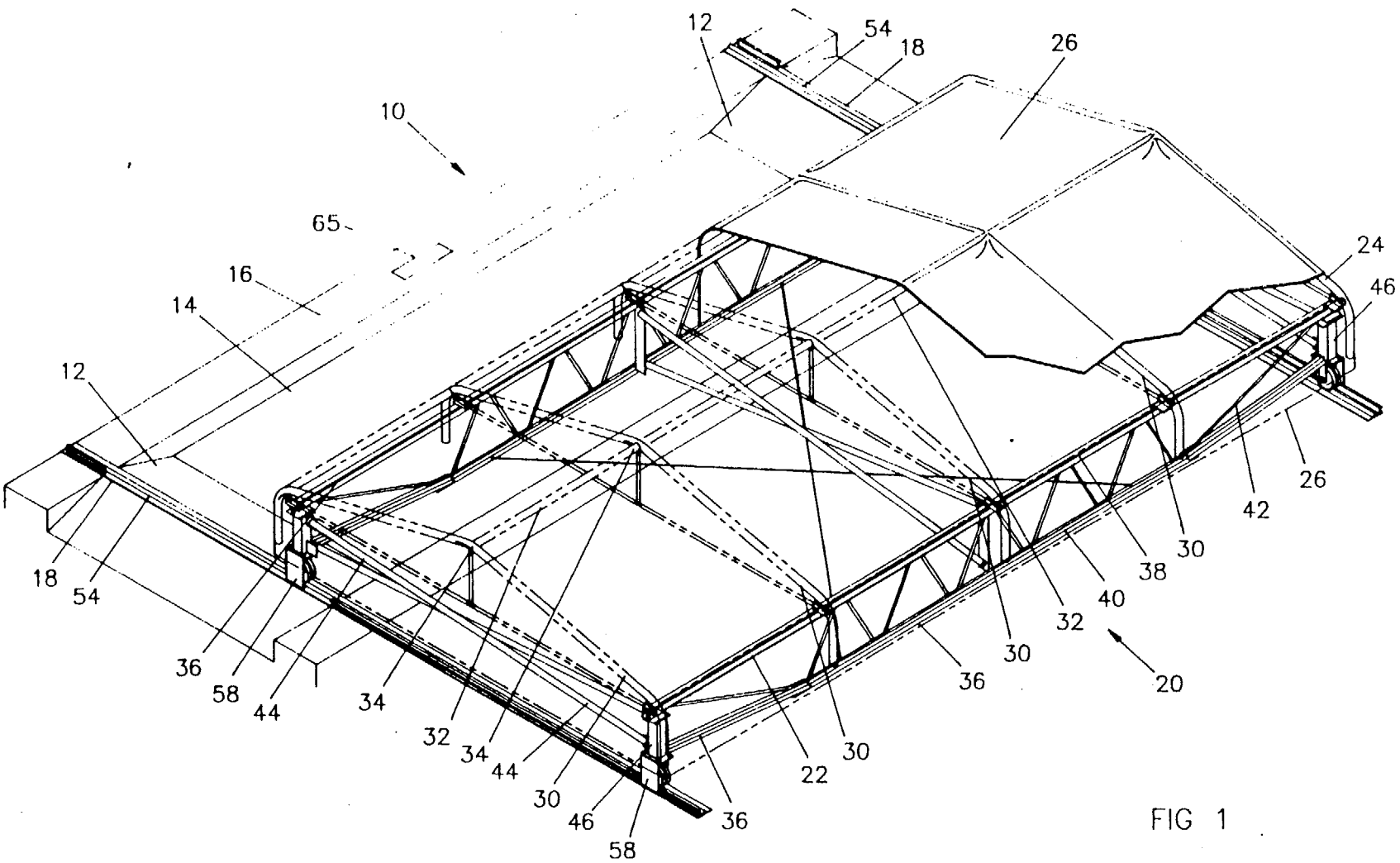
FIG. 1 is a perspective view of a transfer pad cover according to the invention, partially covering a pad.
Figure 2:
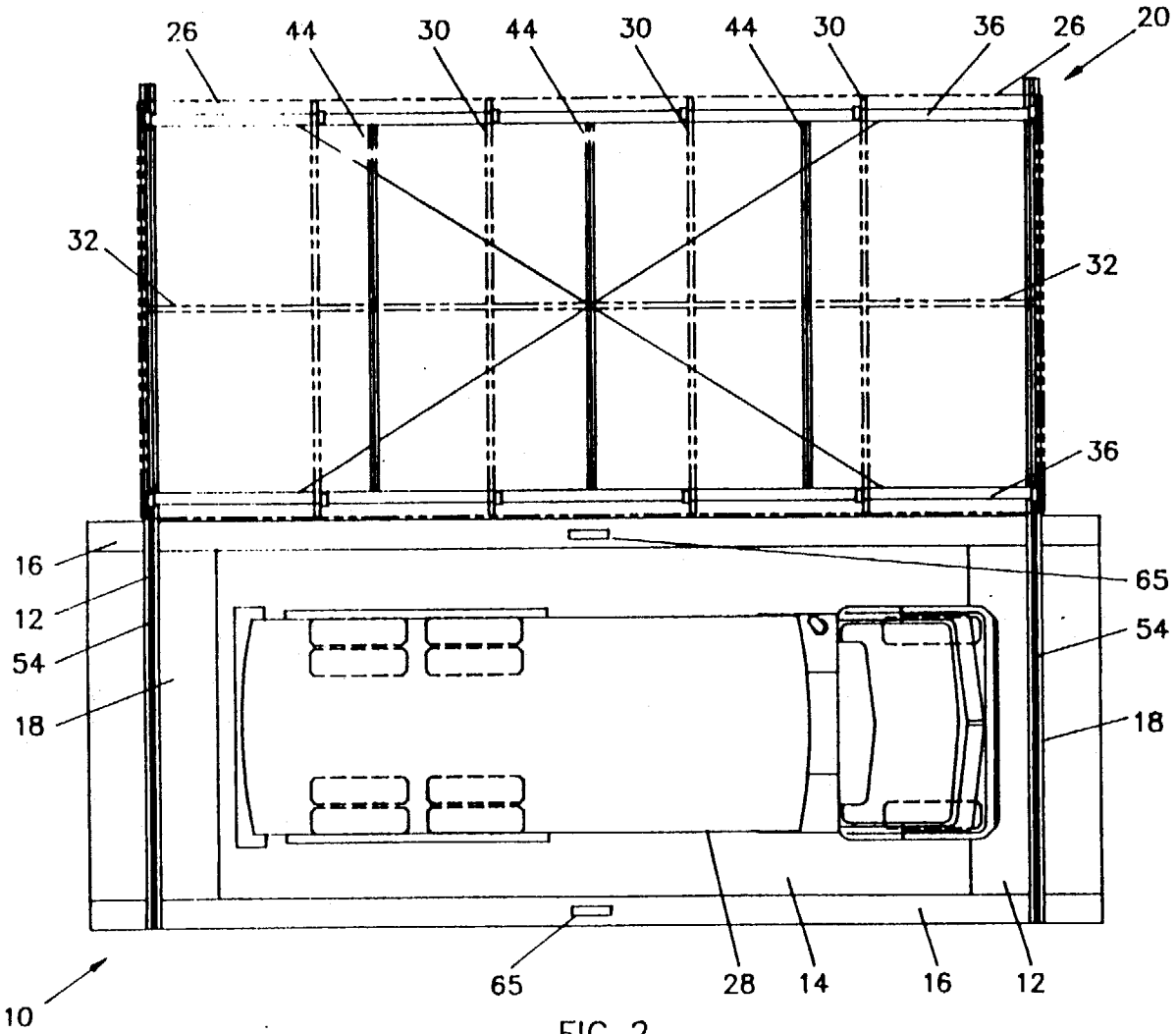
FIG. 2 is a top view of a transfer pad cover moved off the pad while a truck is in position on the pad.

Referring now to FIG. 1, a transfer pad 10 is shown, such as those used for transferring hazardous liquids, petroleum products or other regulated products. The uneven shape of the pad can be seen in the figure, specifically the sidewalls 12 and the basin 14. A deeper central sump (not shown) in the center of the basin 14 may also be present. The sidewalls 12 at the ends of the pad 10 are sloped to serve as ramps for a truck to enter and exit the recessed basin 14 of the pad 10. All on an even plane are two side skirt areas 16 and two end skirt areas 18. Partially covering the pad 10 is a transfer pad cover 20, which includes a support frame 22 and a cover frame 24 resting on top of and secured to the support frame 22. The cover frame 24 is preferably covered with a tarpaulin 26, made of a durable weather-resistant material, such as SHELTER-RITE 8028 polyester fabric, which is a fiber-reinforced, coated synthetic fabric. This tarpaulin 26 serves to protect the transfer pad 10 from precipitation when the cover 20 is in a first "pad-protect" position, fully covering the pad 10. The precipitation could otherwise collect on the pad 10 as contaminated stormwater requiring off-site disposal, or even overfill the pad 10 and carry waste liquids to surrounding areas. FIG. 2 shows a top view of the cover 20 moved to a second "pad-exposed" position, with a truck 28 in position for transferring liquid, dry powder or other similarly handled materials.

In a presently preferred embodiment, the cover frame 24 includes bent cross members 30 and central linking members 32. These members 30,32 are preferably formed of tubular mild steel with an outside diameter of 1.9 inches and a wall thickness of 0.109 inches to reduce their weight while providing strength and stiffness. The cover frame 24 is preferably manufactured in an unassembled form by Rubb Inc., Sanford Municipal Airport, Sanford, Me., USA as part of the Rubb shelter product line. The cross members 30 preferably include a peak angle bend 34 at their midpoint to provide a slope to the tarpaulin 26, preventing water from accumulating and making the removal of any accumulated snow easier. Peak snow loads can reach about 20–90 pounds per square foot. Ice loads, such as those caused by cycles of melting and refreezing snow, are considered similar to snow loads for purposes of this application.

The ends of each of the cross members 30 overhangs the support frame 22 and prevents movement of the cover frame 24 in the direction of the cross members 30. The cover frame 24 is secured to the support frame 22 by any known method, such as bolts or rivets or welding.

The tarpaulin 26 is preferably attached to the cover frame 24 by lacing, tension springs, or elastic cords, although other methods, such as inserting the cross members 30 through sewn pockets, will work similarly, so long as the resulting tarpaulin 26 is taut and weatherproof over its entire surface. As will be described below, the tarpaulin 26 is not taut along its lowest portion, so a trivial amount of precipitation may enter under the cover 20 through the sides, but not enough for significant accumulation or over-spillage.

Of course, other variations of the cover frame are possible, such as different angle bends, different cross member configurations or other tarpaulin materials, provided the advantages of the preferred embodiments are met.

In the presently described embodiment, the main elements of the support frame 22 are two joist members 36 parallel to the longer sides of the pad 10. These joists 36 are constructed in a known fashion with top and bottom support bars 38,40 and diagonal struts 42 connected between the bars 38,40. The joists 36 are preferably manufactured according to the Steel Joist Institute's Open Web Steel Joist, K-series specification, although other joists and truss structures may be used similarly, so long as they perform similarly to the description of the joists 36 below. Connected to and between the two joists 36 are support cross members 44, also preferably formed of iron and of sufficient size and strength to maintain the integrity of the support frame 22 under heavy snow and winds loads, such as 2 inch schedule 40 iron pipe. Preferably, there are three sets of support cross members 44, each set consisting of two members 44 at a slight angle to each other. Other support cross member 44 configurations will work similarly. The strength of the joists may be varied, depending on potential maximum snow loads in the location of installation. In some climates, the snow loads are negligible, requiring minimum strengths of the joists 36.

Figure 3:
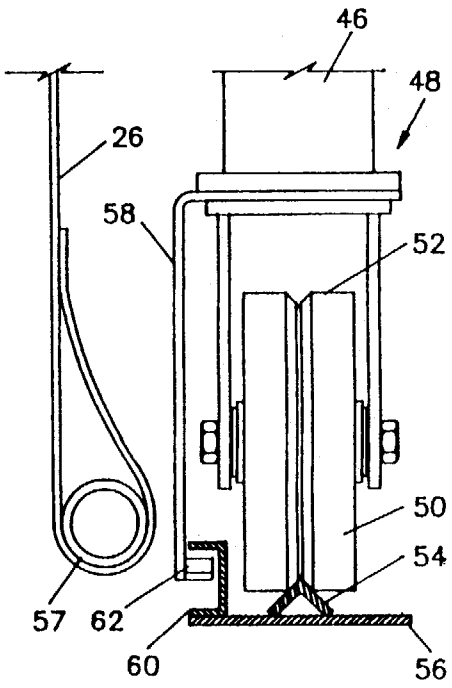
FIG. 3 is a detail front view of a wheel assembly and lift-stop mechanism for a transfer pad cover.

At each end of the joists 36 is preferably a vertical beam 46 that rests on and is secured to a wheel assembly 48, preferably such as that shown in FIG. 3. A wheel 50 having a circumferential groove 52 about its centerline rests on a track formed by an inverted angle iron 54 or similar track material to maintain directional stability of the cover 20 as it is moved on or off the pad. The angle irons 54 are mounted on track bases 56, which are preferably mounted on the end skirts 18 of the pad 10.

As can be seen in FIG. 3, the tarpaulin 26 preferably hangs to near the bottom of the wheel assembly 48, which is below the bottom of the cover frame 24, and also overhangs the outer edges of the pad 10. The bottom portion of the tarpaulin 26, i.e., the portion below the ends of the cross members 30 as in FIG. 1, hangs freely and is preferably biased to a vertical position by a weight 57, which may be a steel tube or rod. By having the tarpaulin 26 overhang the pad 10, only negligible precipitation will penetrate the basin covering scheme and get into the basin 14, perhaps aided by stiff winds.

Strong winds might also move the bottom portion of the tarpaulin 26 and allow wind to pass under and into the interior of the cover 20. Since the support frame 22 and cover frame 24 are relatively light, it might be expected that a stiff breeze or gust of wind could potentially move the cover 20 to the pad-exposed position or carry it off the tracks 54 altogether and away from the pad 10. To prevent the cover 20 from unwanted movement on the tracks 54, the cover 20 can be tied to anchors in its pad-protect position when not in use, or locked there in any known manner.

Preventing the cover 20 from completely blowing away poses a more difficult problem, as the cover 20 must be able to resist being lifted off the tracks 54 at many points along the tracks 54, including when it is in use and rolling on them. Thus, as part of the wheel assemblies 48, an angled stop arm 58 preferably extends from the wheel bracket downward and under an angle bracket 60 attached to the track base 56. Thus, if the cover 20 is lifted by a passing breeze, the inwardly projecting end 62 of the stop arm 58 will engage the underside of the angle bracket 60, preventing further upward movement of the cover 20. The dimensions of the arm 58 and bracket 60 are pre-determined so that at maximum upward displacement, the wheels 50 will not be completely above the peak of the angle irons 54 and will re-seat themselves automatically when the breeze has passed. It is contemplated that this lift-prevention feature could be designed in other ways, such as having the projecting end 62 and bracket 60 reversed or using more complicated wheel assemblies that are secured to the tracks 54. However, these are not preferred. The brackets 60 also preferably do not extend over a portion of the side skirts 18 when the track bases are surface mounted, thus avoiding damage to the brackets 60 from repeat truck overruns.

In the unloaded condition, the center of the bottom support bar 40 of the joists 36 will preferably be approximately 1.5 inches off of the side skirts 16 in this presently described embodiment of the invention, allowing the bar 40 to clear any minor variations in the surface of the pad 10 as it traverses the pad 10. If the pad is uneven at the area under the center of the joists 36, stop blocks 65 or shims can be secured to the pad under the joists 36 to make the distance between the pad 10 and the joists 36 approximately 1.5 inches.

As snow 66 falls onto the tarpaulin 26 and accumulates, the weight of the snow 66 will make it unsafe for a driver to move the cover 20 manually or to use any motor that might be driving the cover 20. The snow 66 might shift suddenly and fall onto and injure the driver or fall into the basin 14 of the pad 10, defeating a purpose of the cover 20. The tremendous weight of the snow 66 also increases the stress on the wheels 50 as the cover 20 moves and could damage any driving motor. To alleviate the load, the snow 66 can be swept off by a driver or other worker, aided by the sloped angle of the tarpaulin 26.

Figure 4:
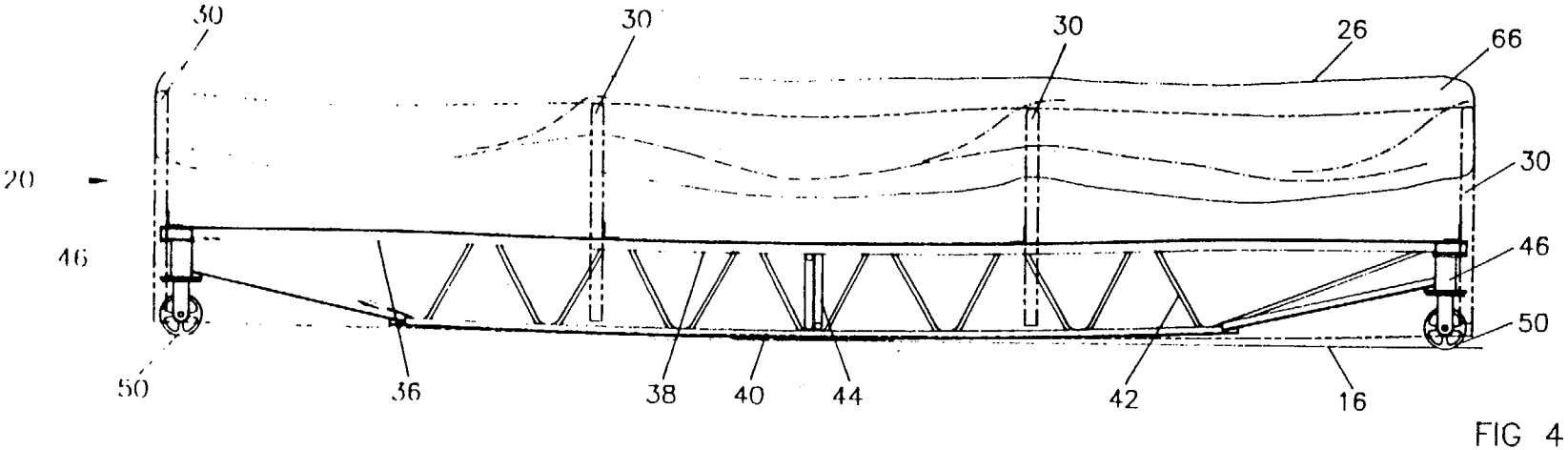
FIG. 4 is a side view of a transfer pad cover fully deflected due to a snow load.

However, to eliminate the driver's responsibility to make judgements about the snow load and to automatically indicate when the snow load is substantial and it is unsafe and improper to move the cover 20, the joists 36 are preferably designed to flex downward slightly under heavy snow loads greater than a predetermined critical load. In the preferred embodiment now being described, the vertical displacement or sag of the mid-section 64 of the joist 36 in response to the critical load is around 1/240th of the joist span, e.g., the above-mentioned 1.5 inches. As snow 66 accumulates, the joists 36 will gradually flex to a downward-bowed position. As more snow 66 accumulates past the critical load, which is preferably equivalent to a 6 inch-deep layer of wet snow and which makes moving the cover 20 unsafe, the joists 36 will have gradually deflected to the point where they rest on the pad 10 or on top of the stop blocks 65, as shown in FIG. 4.

In this position, the joists 36 are prevented from further deflection, which could be damaging to the joists 36 and support frame 22. The support and cover frames 22,24 are preferably designed to withstand the local building code requirements for maximum snow load once the joists 36 are resting on the pad 10. The weight bearing on the cover 20 and the joists 36 as they rest on the skirts 16 of the pad 10 will also create a frictional force between the joists 36 and the pad that will be large enough that moving the cover 20 manually becomes nearly impossible. Should a driver or other worker not realize the heavy snow load or not see the joists 36 resting on the pad 10, the tremendous effort he will need to exert in attempting to move the cover 20 or failure of a motor to accomplish the task will automatically and immediately alert the driver to the excessive snow load.

Upon removing the snow 66 by brushing or other methods, the joists 36 will return to their level position. It will then again be possible for the driver to manually move the cover 20 off the pad 10.

The absence of supporting structures under the mid-length of the joists 36 not only provides for the prevention of movement in unsafe conditions discussed above, but also makes it possible to move the cover 20 laterally with respect to the pad 10. This is preferred since a truck 28 drives onto the pad 10 from one end and then continues forward, after transferring liquid, to drive off the opposite end of the pad 10. To compensate for the uneven longitudinal cross-section of the pad 10, formed by the sidewalls 12 and basin 14, would require quite complex and vertically adjusting support wheels. If tracks to support these complex wheels were set into the basin 14, they would quickly become fouled and difficult to use from being often submerged in thick and corrosive liquids. In the preferred embodiment, the long joists 36 only require tracks 54 that are embedded in the level end skirts 18 of the pad 10.

Except for the minimal areas at the bottom of the tarpaulin 26 where wind can enter, there is no entrance to the interior of the cover 20, making it unusable as a shelter for workers or drivers. The preferred maximum height of only three feet also makes the cover 20 non-functional as a dwelling. Advantageously, the cover 20 thus does not qualify as a structure according to many building or fire codes and will not be subject to the strict inspection and construction regulations or the significant tax burden normally associated with dwellings, even of the temporary type.

Figure 5:
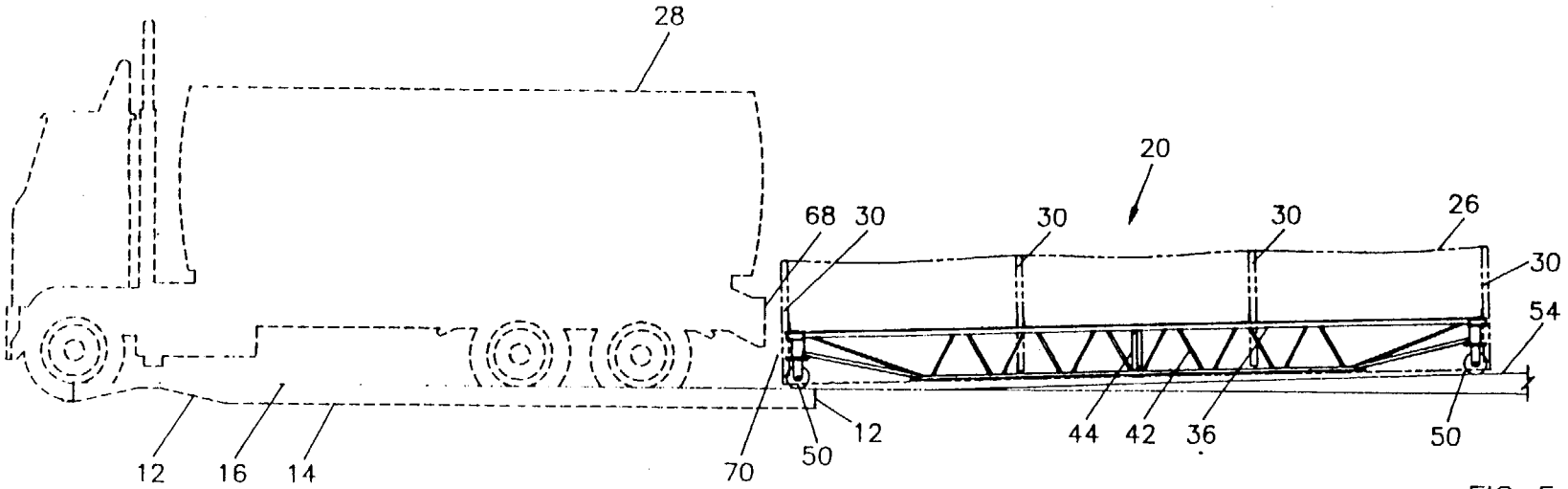
FIG. 5 is a side view of an alternate embodiment of the transfer pad cover of the invention.

In an alternate embodiment, shown in FIG. 5, trucks 28 will enter and exit the pad 10 from the same end, making longitudinal, rather than lateral, movement of the cover 20 a possibility. In this embodiment, the structure of the support and cover frames 22,24 and tarpaulin 26 is identical, except that the wheels 50 have been rotated 90°. The tracks 54 are also now laid longitudinally to the pad 10 and embedded in the level side skirts 16. When the truck 28 backs onto the pad 10, the rear bumper 68 of the truck 28 will abut the end support cross members 44 or the vertical beams 46 and push the cover 20 along the tracks 54 to a pad-exposed position adjacent an end skirt 18 of the pad 10, as shown in FIG. 5.

It can also be seen that the portion of the tracks 54 that is off the pad 10 is preferably sloped slightly upward as it leaves the pad 10, at an angle of about 1°-2°. First, this will prevent the truck 28 from pushing the cover 20 with too much force and having it glide freely off the end of the tracks 54, regardless of whether there is a stop mechanism at the end of the tracks 54. Second, the cover 20 will be biased by the slope against the truck bumper 68 and will thus automatically return to its original pad-protect position as the truck 28 exits the basin.

This embodiment makes it possible for the driver to move his truck 28 onto the pad 10, transfer the liquid, and drive away without having to leave the truck cab to move the cover 20 either off or back onto the pad 10. No motors for the cover of this embodiment are necessary, thus saving equipment, operation and maintenance costs. To protect the end of the cover 20 from damage, it is contemplated that a bumper 70 is applied to the end of the cover 20 to abut the bumper 68 of the truck 28.

Alternatively, either in place of or in addition to the gravity-driven sloped rails returning the cover 20 to its pad-protect position, a spring and pulley system could be installed between the cover 20 and the pad 10 to bias the cover 20 to its pad-protect position.

Figure 6:
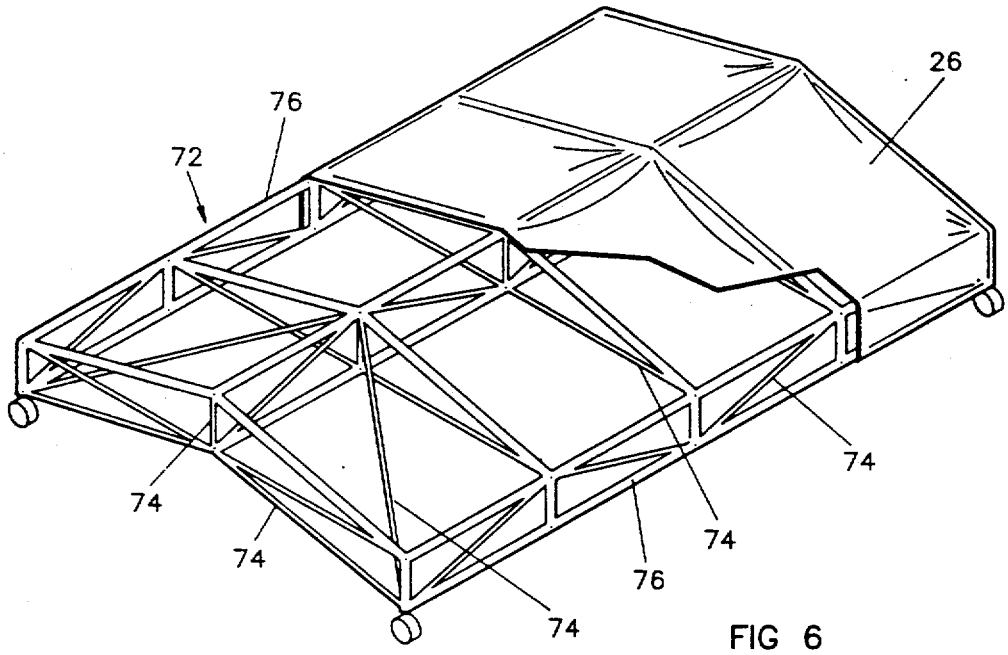
FIG. 6 is a perspective view of another embodiment of a transfer pad cover according to the invention.

In another embodiment of the present invention, in place of the joists and cover frame shown in FIGS. 1-5, a space-filling cover frame 72, such as that shown in FIG. 6, may be used. This is possible because the space between the cover frame 72 and the pad 10 is not needed or utilized. With this frame 72, the weight-load of the cover frame 72 is more evenly distributed with a number of internal support members 74. The sides of the frame 76 still remain suspended only at their ends, and are designed to sag under snow or other loads as in the above-described embodiments. The tarpaulin 26, wheels (shown diagrammatically) and associated tracks, etc. would be similar to those discussed with respect to FIGS. 1-5.

At some transfer pads 10, space is not available adjacent to the transfer pad 10, either laterally or longitudinally, making it impossible to wheel the rigid cover off of the pad to allow a truck to enter. Therefore, the embodiments of the transfer pad cover shown in FIGS. 7-9, while incorporating above-mentioned features of the invention, also include mechanisms to move the cover to its pad-exposed position without requiring adjacent space generally equal to the pad itself.

Figure 7:
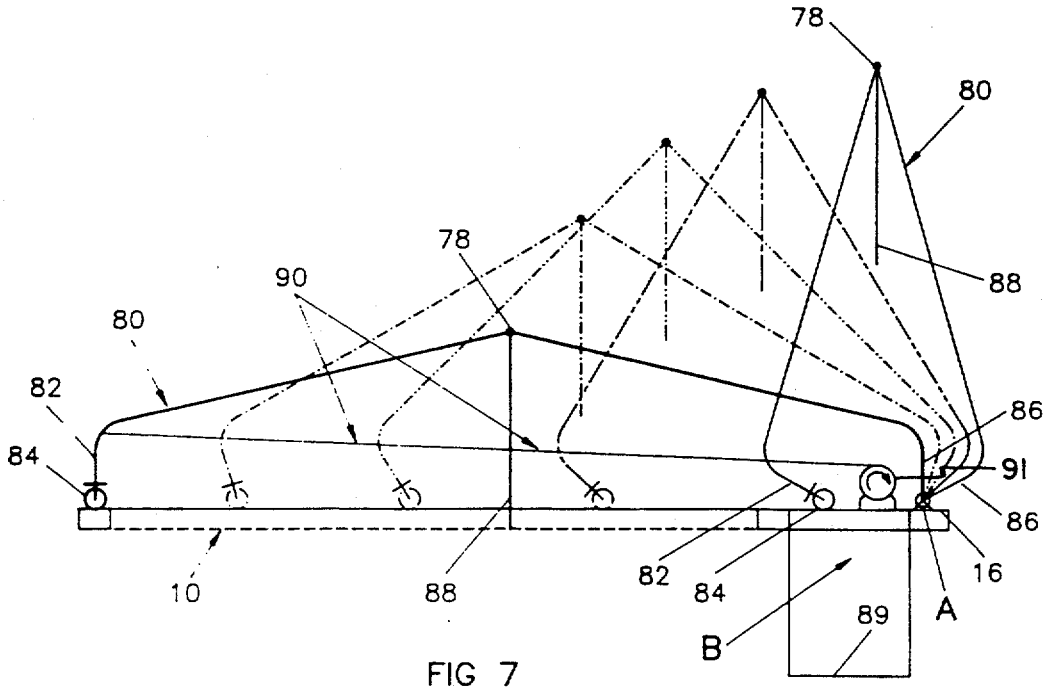
FIG. 7 is a side schematic view of a transfer pad cover according to another embodiment.
Figure 7A:
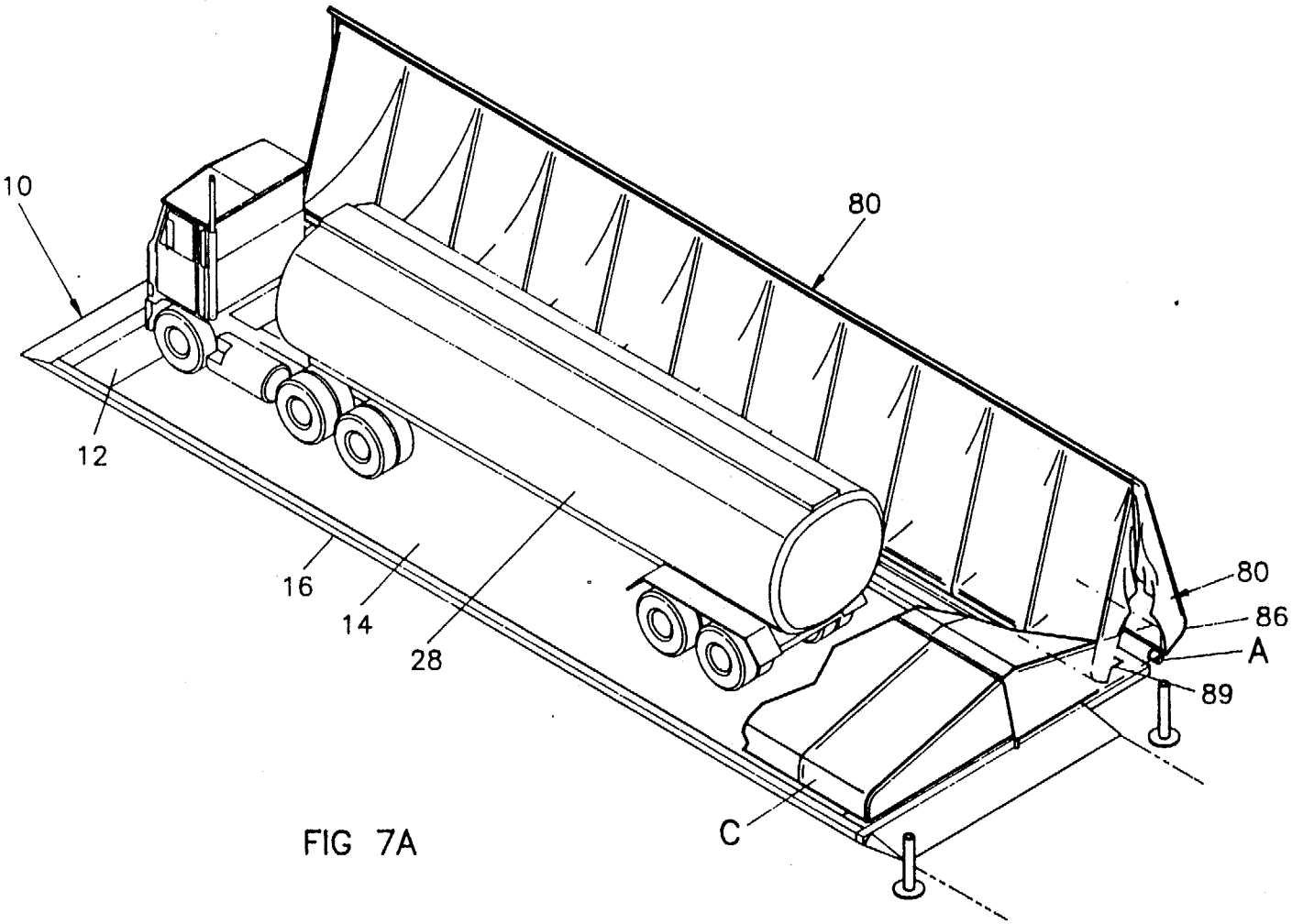
FIG. 7*a* is a perspective view of a transfer pad cover as shown schematically in FIG. 7 and a truck.

In FIG. 7, a schematic is shown in which the transfer pad cover is generally similar to the cover 20 shown in FIG. 1. However, at the peak 78, the cover frame 80 is hinged, allowing it to fold along its peak 78. In this embodiment, only one side 82 of the frame 80 has wheels 84. The other side 86 is pivotally anchored to a side skirt 16 of the transfer pad 10 (at position A).

The vertical support of the frame 80 is also different in this embodiment compared to the other embodiments. Since the peak 78 is hinged, it lacks the ability to support the frame 80 between the two side joists 82,86. Also, since the frame 80 as a whole does not move across the pad 10, which would require it to adjust to the non-level basin 14, it is possible to use support members that rest on the pad 10 itself. In this case, preferably at least one central support column 88 is suspended from the peak 78. In the pad-exposed position, the column 88 can be seen to hang freely from the peak 78. However, when moved to the pad-protect position (with several intermediate steps shown in dotted line form in FIG. 7) the column 88 comes to rest on the pad basin 14. To keep the column 88 erect, and to provide added support to the overall frame 80, there are cables 90 attached between the column 88 and the side joists 82,86 that become taut when in the pad-protect position. It is contemplated that a one-way hinge could be designed to support the frame 80 in the pad-protect position, but such a hinge would likely be heavy and expensive.

Of course, there can be a plurality of columns 88 in this embodiment, each with cables 90 for support. Also, the side joist 82 that does move across the pad is preferably supported only at its ends and is preferably designed to sag under load to contact the side skirt 16, as discussed in detail above. It can be seen at position B that some additional space to the side of the pad 10 is necessary, although it is a fraction of that needed for the embodiments of FIGS. 1-6. Under the area B is a spill basin 89 to retain excess fluids.

To move the cover 80 shown in FIG. 7, many methods are contemplated. Preferably, a winch system 91 is installed on the side of the pad near joist 86. A cable 93 is then attached under the frame 80 to the movable joist 82. By pulling the cable 93 with the winch system 91, the movable joist 82 moves toward the hinged joist 86, causing the frame 80 to fold into a configuration such as that shown in FIG. *7a*. In FIG. *7a*, it can be seen how a truck 28 rests on the pad 10 while the frame 80 is folded to one side. Part of the frame in its closed position is shown at position C. Other methods of moving the frame include manually pushing the movable side joist 82 toward the hinged joist 86.

Figure 8:
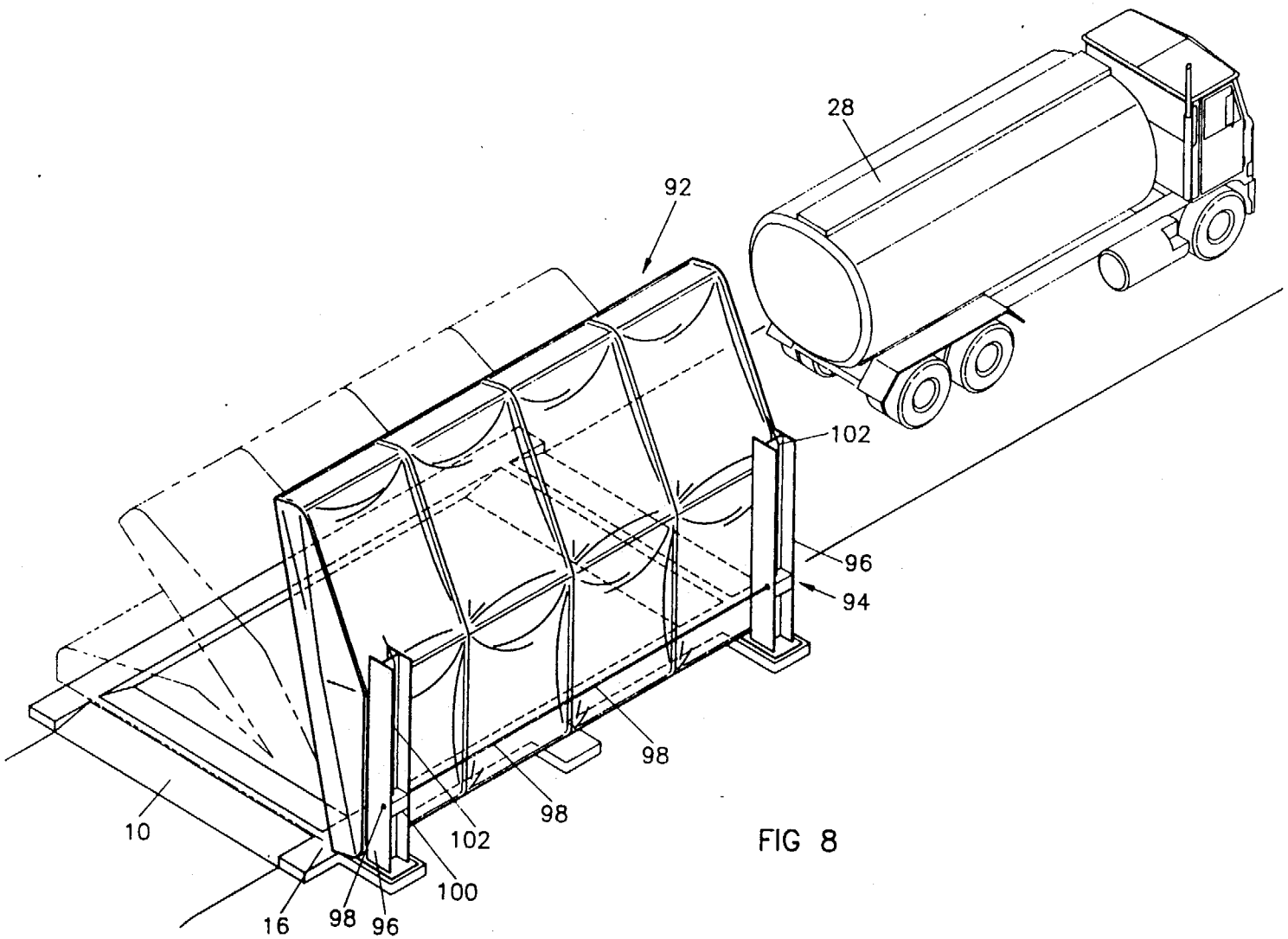
FIG. 8 is a perspective view of a transfer pad cover and truck according to another embodiment of the invention.

In FIG. 8, another alternative to the sliding motion of the cover 20 in FIG. 1-5 is shown, in which the cover frame 92 is hinged to one of the side skirts 16 and pivoted along that side skirt 16 to a vertical, rather than horizontal position. This preferably includes a support system 94, such as the two winch columns 96 shown in FIG. 8, and a lifting mechanism. It is also contemplated that the cover frame 92 could be pivoted manually and locked to the columns 96. The cover frame 92 itself is similar to that of any embodiment of FIGS. 1-6, except that it has no wheels.

The winch system 94 preferably includes an axle 98 that extends between the two columns 96. The axle 98 preferably protrudes through one of the columns 96 to allow a manual crank handle (not shown) to be attached. In addition, at least one motor 100 is also attached to the axle 98. The winch cables 102 are wound around the axle 98, extending over the top or through the columns 96 to attachment points on the cover frame 92, such as at the peak. The cables 102 may be attached at many locations on the cover frame 92.

Since no part of the cover frame 92 moves across the pad, the snow load sagging feature would not prevent movement of the cover frame 92. However, the longitudinal sides of the frame 92 are preferably designed to sag under load similar to the previous embodiments, which would provide a visual indication to an operator that the snow load is too great. In addition, the motor 100 can be designed to lift only a certain amount of weight, automatically cutting off if the cover frame 92 is overly burdened with snow or other load.

Figure 9:
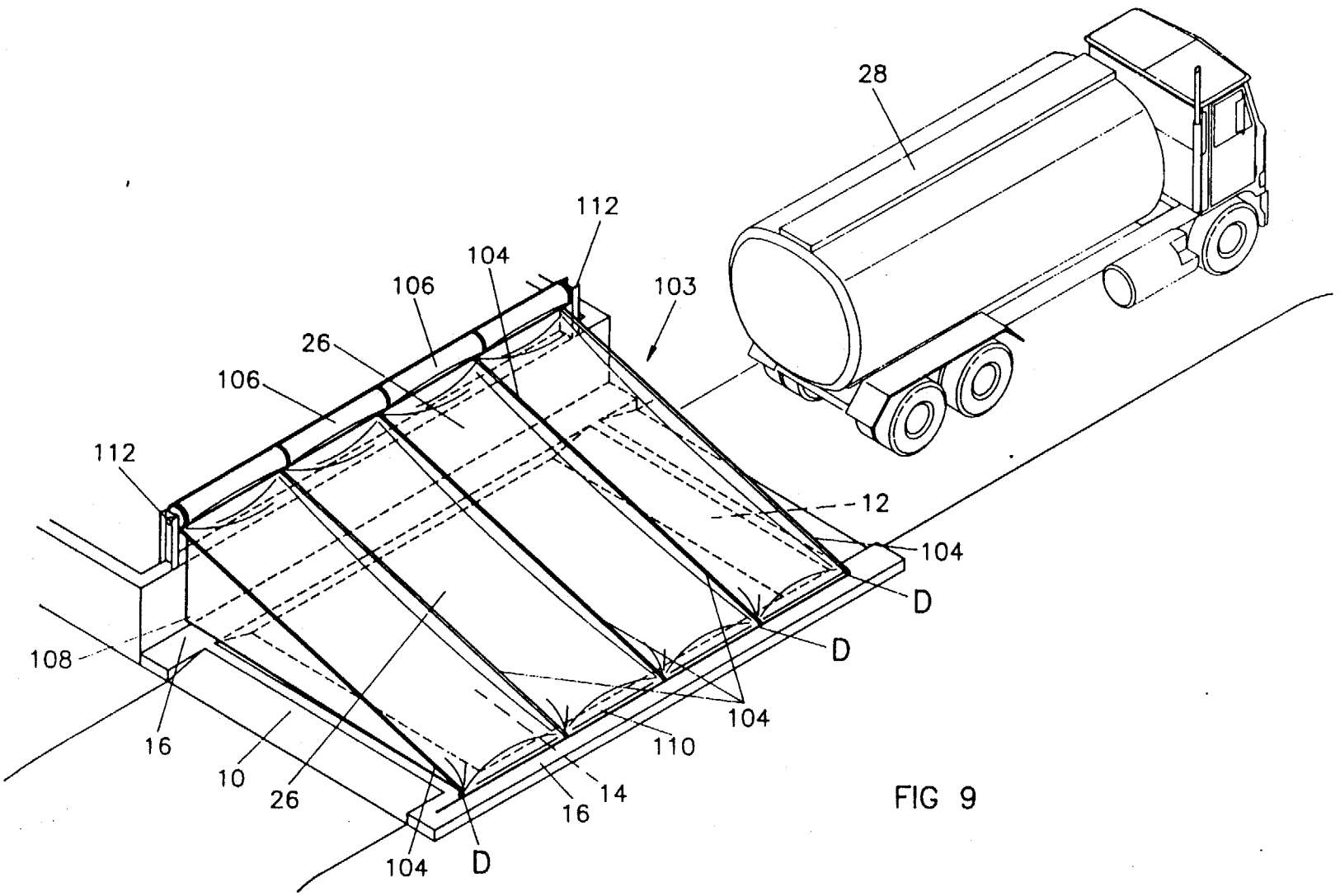
FIG. 9 is a perspective view of a transfer pad cover and truck according to another embodiment of the invention.

In FIG. 9, a transfer pad cover 103 requiring a minimum of storage space is shown. This embodiment eliminates much of the frame, leaving only a set of flexible cables 104 extending from a take-up reel 106 mounted on one side skirt 16 to the opposite side skirt 16. A tarpaulin 26' is secured and supported by the cables 104. Side flaps 108 can also be provided to completely cover the pad 10. The distal end 110 of the extended tarpaulin 26' is attached to the pad 10 at several points D, preferably at the cables 104, which are released when moving the cover 103 to its pad-exposed position.

The take-up reel 106 is preferably mounted on two brackets 112 that provide a locking mechanism, such as a ratchet, to keep the cables 104 taught when in the pad-protect position. To expose the pad 10, the cables 104 and tarpaulin 26' are detached from the pad 10. Either manually or with a motor, the take-up reel 106 rotates and winds up the cables 104 and tarpaulin 26'. If a snow load on the cover 103 is too great, it would be difficult or impossible to move manually, and the motors would be designed to cut-off automatically at a certain load.

Figures 10A, 10B, 10C:
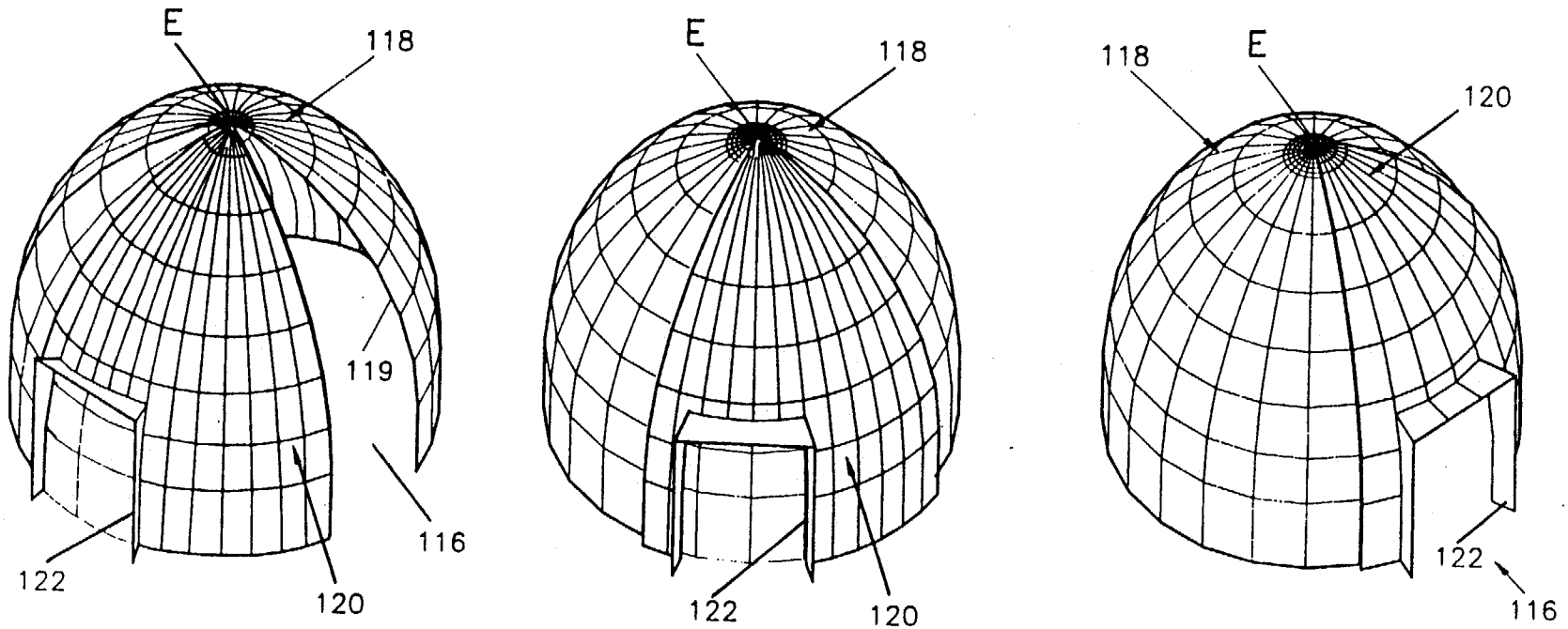
FIGS. 10*a*, 10*b*, and 10*c* are perspective views of a transfer pad cover according to another embodiment of the invention.

FIGS. 10*a*–10*c* show an alternate embodiment of the transfer pad cover 114, in which the pad 116 is used for the storage of dry materials, such as sand, gravel and salt. With pads 116 of this nature, large delivery trucks cart the material to the pad 116 and dump it onto the pad 116, where it remains until parceled out to other trucks for delivery or dispersion. These materials are kept in domed structures to protect them from being swept away or dissolved by wind or precipitation.

In this embodiment, a stationary frame portion 118 includes approximately three-quarters of a dome with the remainder an open gap 119. Pivotally attached to the stationary frame is a movable frame portion 120, which includes a portion of a dome covering at least the gap 119 of the stationary frame 118. The movable frame 120 also includes a door aperture 122. The frame portion 120 is pivotally connected to the stationary frame 118 at the peak of the dome (position E). The bottom of the frame portion 120 is movable along the pad surface with wheels, sliding tracks or any other mechanism.

Essentially, there are three operating positions of the movable portion, shown in FIGS. 10*a*–10*c*. In FIG. 10*a*, the movable frame is pivoted to expose substantially all of the gap 119 in the stationary frame 118. This allows a large delivery truck to back into the pad area 116 and dump its contents. As can be seen, the door aperture 122 is positioned over a part of the stationary frame 118 and thus the door cannot be used.

In FIG. 10*b*, the pad 116 is covered, i.e., the movable frame 120 covers the gap 119 while the door aperture 122 remains positioned over a part of the stationary frame 188. Thus, nothing can be transferred to or from the pad 116. The contents on the pad 116 are also now protected from wind and precipitation.

In FIG. 10*c*, the door aperture 122 is positioned over the gap 119 to open the contents of the pad 116 to smaller vehicles or laborers, who can load the pad contents onto trucks for delivery or dispersal. It can be seen that a significant portion of the gap 119 remains covered by the movable frame 120 to protect the contents from any incidental winds or precipitation during transfer.

To avoid any damaging contact between the two frames 118,120 during pivoting, the movable frame can be large enough to create a gap between the two frames 118,120. Alternatively, spacers, tracks or other sliding mechanisms (not shown) can be mounted between the frames 118,120. The bottom of the movable frame 120 may be designed to sag to the pad surface under loads to prevent dangerous movement. Further, any sliding mechanism can incorporate a mechanism for preventing relative movement of the two frames 118, 120 when the load on the frame 118 is too great.

It can thus be seen that a cover is provided for an uneven transfer pad 10 that is easy to move between a pad-protect and pad-exposed position. In the preferred embodiments, lateral movement of the cover 20 is possible due to the joists being supported only at each end. The end-suspended joists also automatically make the cover nearly impossible to move in dangerous snow load conditions by sagging downwardly to and frictionally abutting the pad surface.

While the embodiment of the invention shown and described is fully capable of achieving the results desired, it is to be understood that this embodiment has been shown and described for purposes of illustration only and not for purposes of limitation.

What is claimed is:

1. A cover for protecting a transfer pad from precipitation, said transfer pad having a raised perimeter, said cover comprising:

a foldable cover frame having a water-proof sheet material secured thereto, said foldable cover frame extending substantially over the entire surface of said pad when the cover is in a first position, said cover frame having two longitudinal sides, each having a mid-section and two longitudinal ends, said cover frame being foldable along a longitudinal axis, one of said longitudinal sides being pivotally mounted to said pad; and level surfaces on said pad, said surfaces being positioned under the longitudinal ends of the other of said longitudinal sides, said other of said sides being movably engaged to said surfaces at said longitudinal ends, said midsection of said other of said sides being raised above said raised perimeter, whereby said other of said sides may be moved laterally from a position substantially away from said one of said sides to a second position adjacent said one of said sides without engaging said pad, said lateral movement causing said cover to fold.

2. A cover as in claim 1, further comprising:

means for moving the other of said sides from said first position to said second position.

3. A cover as in claim 2, wherein said foldable cover has a longitudinal apex, said longitudinal axis being at said apex, said means for moving being connected to said cover frame at said apex.

4. A cover as in claim 3, wherein said means for moving includes cut-off means such that said means for moving will not move said cover if a load on said sheet material is greater than a predetermined load.

5. A cover for protecting a transfer pad from precipitation, said transfer pad having a raised perimeter, said cover comprising:

a pivotable cover frame having a water-proof sheet material secured thereto, said pivotable cover frame extending substantially over the entire surface of said pad when the cover is in a first position, said cover frame having two longitudinal sides, each having a mid-section, said cover frame being pivotably mounted to said pad along one of said longitudinal sides, said cover frame being pivotable to a second substantially vertical position such that said pad is exposed;

means for pivoting said cover from said first position to said second position.

6. A cover as in claim 5, wherein said means for pivoting includes cut-off means such that said means for pivoting will not pivot said cover if a load on said sheet material is greater than a predetermined load.

7. A cover for protecting a transfer pad from precipitation, said transfer pad having a raised perimeter, said cover comprising:

a movable cover having a water-proof sheet material secured thereto, said moveable cover extending over said pad when said cover is in a first position, said cover having longitudinal ends and a mid-section;

track means mounted on said pad and extending to an area adjacent to said pad, said track means positioned under said longitudinal ends of said cover, said cover being movably engaged to said track means at said longitudinal ends, said mid-section of said cover being raised above said pad, whereby said cover may be moved laterally between said pad and said area adjacent to said pad without said mid-section engaging said pad.

8. A cover according to claim 7, wherein said cover has a stiffness such that said mid-section will sag a first predetermined distance and frictionally engage said pad in response to a predetermined load on said sheet material such that said cover will substantially resist lateral movement.

9. A cover according to claim 8, further comprising wheel assemblies mounted on said cover and riding on said track means, said track means including means for preventing said wheel assemblies from lifting off of said track means.

* * * * *